US012196503B2

(12) United States Patent
Crayssac et al.

(10) Patent No.: US 12,196,503 B2
(45) Date of Patent: Jan. 14, 2025

(54) HEAT EXCHANGER COMPRISING AT LEAST ONE HEAT EXCHANGE STRUCTURE WITH A STRIATED SURFACE

(71) Applicant: L'Air Liquide, Société Anonyme pour l'Etude et l'Exploitation des Procédés Georges Claude, Paris (FR)

(72) Inventors: Frédéric Crayssac, Velizy (FR); Jacopo Seiwert, Versailles (FR); Marie-Adelaide Cremieux, Jouy-en-Josas (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 283 days.

(21) Appl. No.: 17/953,843

(22) Filed: Sep. 27, 2022

(65) Prior Publication Data

US 2023/0100214 A1 Mar. 30, 2023

(30) Foreign Application Priority Data

Sep. 27, 2021 (FR) ..... 2110123

(51) Int. Cl.
*F28D 9/00* (2006.01)
*F28F 13/18* (2006.01)

(52) U.S. Cl.
CPC ..... *F28D 9/0062* (2013.01); *F28F 13/185* (2013.01)

(58) Field of Classification Search
CPC ..... F28D 9/0062; F28F 13/185; F28F 13/182
See application file for complete search history.

(56) References Cited

U.S. PATENT DOCUMENTS 4,186,159 A * 1/1980 Huber ..... F28F 25/087 165/166
D254,506 S * 3/1980 Holmberg ..... D23/358
5,514,248 A * 5/1996 Okuda ..... F25B 47/00 165/913

(Continued)

FOREIGN PATENT DOCUMENTS

DE 10 2010 019369 11/2011
EP 1 748 270 1/2007

(Continued)

OTHER PUBLICATIONS

French Search Report for corresponding FR 2110123, Apr. 3, 2022.

*Primary Examiner* — Jon T. Schermerhorn, Jr.
(74) *Attorney, Agent, or Firm* — Elwood L. Haynes

(57) ABSTRACT

The invention relates to a plate and fin heat exchanger for bringing into a heat exchange relationship at least one refrigerant fluid and one calorigenic fluid, having a plurality of plates arranged parallel to a longitudinal direction so as to define a plurality of passages between said plates, at least one passage being formed between two adjacent plates and having at least one heat exchange structure equipped with at least one series of fins extending parallel to the longitudinal direction and following one another in a lateral direction, the fins, within the passage, defining channels for the flow of the fluids. According to the invention, at least one fin, over at least part of its surface, has a surface texturing in the form of striations arranged parallel to the longitudinal direction.

14 Claims, 3 Drawing Sheets

(56) References Cited

U.S. PATENT DOCUMENTS

| | | | | |
|---|---|---|---|---|
| 5,876,638 | A * | 3/1999 | Sunder | F25J 3/04909 261/112.2 |
| 6,834,515 | B2 * | 12/2004 | Sunder | F28F 13/185 62/643 |
| 10,302,372 | B2 * | 5/2019 | Minami | B21D 53/04 |
| 2005/0121181 | A1 | 6/2005 | Szulman et al. | |
| 2012/0318485 | A1 | 12/2012 | Yabe et al. | |
| 2013/0045411 | A1 | 2/2013 | Bauer et al. | |
| 2021/0088292 | A1 | 3/2021 | Crayssac et al. | |

FOREIGN PATENT DOCUMENTS

| | | |
|---|---|---|
| FR | 2 834 783 | 7/2003 |
| FR | 3 075 340 | 6/2019 |
| JP | 2018 132283 | 8/2018 |

* cited by examiner

HEAT EXCHANGER COMPRISING AT LEAST ONE HEAT EXCHANGE STRUCTURE WITH A STRIATED SURFACE

CROSS REFERENCE TO RELATED APPLICATIONS

This application claims the benefit of priority under 35 U.S.C. § 119 (a) and (b) to French Patent Application No. 2110123, filed Sep. 27, 2021, the entire contents of which are incorporated herein by reference.

BACKGROUND

The present invention relates to a heat exchanger of the plate and fin type, comprising at least one heat exchange structure with a striated surface.

The present invention is particularly applicable in the field of the cryogenic separation of gases, in particular the cryogenic separation of air (in what is known as an ASU, for Air Separation Unit) that is utilized for the production of pressurized gaseous oxygen. In particular, the present invention can be applied to a heat exchanger that vaporizes a refrigerant fluid, for example liquid oxygen, by exchange of heat with a calorigenic fluid, for example gaseous nitrogen.

If the heat exchanger is in the bottom of a distillation column, it may constitute a vaporizer-condenser operating as a thermosiphon for which the heat exchanger is immersed in a bath of liquid oxygen flowing down the column or a vaporizer that operates in falling-film vaporization mode and is fed directly with the falling liquid of the column and/or by a recirculation pump.

The present invention can also be applied to a heat exchanger that vaporizes at least one flow of a liquid-gas mixture, in particular a flow of a mixture of multiple constituents, for example a mixture of hydrocarbons, by exchange of heat with at least one other fluid, for example natural gas.

The present invention can also be applied in the field of hydrogen liquefaction. In particular, the invention can be applied to a heat exchanger, in particular a catalytic heat exchanger, in which a flow of gaseous hydrogen is cooled, or even liquefied entirely or in part, by exchange of heat with a flow of refrigerant fluid, and also to a cooling and/or liquefying method implementing said heat exchanger.

The technology commonly employed for a heat exchanger is that of aluminium brazed plate and fin or corrugated-fin exchangers, which make it possible to obtain devices that are highly compact and offer a large heat exchange surface area. These heat exchangers comprise plates separating a stack of passages for the various fluids to be brought into a heat exchange relationship. Heat exchange structures, generally corrugated structures or corrugations formed by a succession of corrugation legs or fins, are inserted between the plates, delimiting, in the passages, channels in which the fluids flow and forming additional heat exchange surfaces.

In the case of vaporizer-condensers operating in falling-film vaporization mode, a part of the unit is dedicated to the distribution of the refrigerant fluid in the vaporization passages. During operation, the liquid passes through holes ensuring a primary distribution of the liquid across the entire width of the passage. The liquid predistributed in this way then flows through corrugations with horizontal generatrices, which ensures a finer distribution, referred to as secondary distribution, with a view to apportioning the liquid between the channels formed by downstream heat exchange corrugations with horizontal generatrices. The liquid thus tackles these structures by trickling as uniformly as possible along all the walls of the passage assigned to it, namely by forming on these walls a continuous falling film.

At the same time, the gaseous refrigerant fluid arrives in the heat exchanger via a feed tank and then flows downwards along the condensation passages. In so doing, the calorigenic fluid gradually gives up heat to the refrigerant fluid that is in the adjacent passages, so that the refrigerant fluid vaporizes and the calorigenic fluid condenses. Consequently, a film of liquid calorigenic fluid forms on the surface of the heat exchange structures with which the condensation passages are fitted and flows downwards. The flow is referred to as falling film.

It will be noted that, in the case of vaporizer-condensers operating as a thermosiphon, the liquid oxygen enters the vaporization passages via the bottom of the heat exchanger body and flows upwards therein, the gaseous nitrogen entering condensation passages from the top and flowing downwards in a falling film.

The performance of a heat exchanger is linked to the heat exchange coefficient of the heat exchange structures in contact with the fluids. The heat exchange coefficient of a structure depends notably on the nature of the material of which it is made, on the porosity of this material, on its surface state and on the flow regime of the fluids.

In falling-film condensation, the heat transfer resistance is substantially proportional to the thickness of the liquid film. In accordance with the Nusselt theory, the heat transfer resistance varies with the ⅓ power of the flow rate, thereby leading to a rapid rise in the resistance at locations on the heat exchange structures at which the fluid condenses. There follows a reduction in the heat transfer capacity between the fluid to be condensed and the heat exchange structure.

There is therefore interest in draining as much liquid as possible towards a small part of the heat exchange surface in order to dry out the other part of said surface to the greatest possible extent, while still trying to maximize this dried-out surface part.

In the same way, the heat transfer resistance in falling-film vaporization is substantially proportional to the thickness of the liquid film. There is therefore interest in draining as much of the falling liquid flow as possible towards a small part of the heat exchange surface in order to minimize the thickness of liquid film on the other part of the heat exchange surface.

To this end, notably the document FR-A-2834783 discloses a corrugated heat exchange structure making it possible to evenly drain the liquid in the corners of the channels formed by the corrugations. The structure comprises perforations, slots or reliefs arranged over the height of the corrugation legs in order to dry out a part of their surface.

However, these solutions are not entirely satisfactory. This is because, even if the thickness of liquid film becomes greater in the corners of the channels, a thickness of liquid film still remains on the corrugation legs which limits the condensation or vaporization heat exchange coefficient. Moreover, these solutions are limited since they do not make it possible to dry out the entire surface of the corrugation legs; they only make it possible to dry out the parts located just above the perforations or reliefs installed in the channels. In addition, the condensing liquid nitrogen has an increased wetting power and rapidly covers the heat exchange surface.

SUMMARY

The object of the present invention is to solve all or some of the problems mentioned above, notably to propose a heat exchanger of the plate and fin type in which the heat exchange coefficient of the heat exchange structures is increased.

The solution according to the invention is then a heat exchanger of the plate and fin type for bringing into a heat exchange relationship at least one refrigerant fluid and one calorigenic fluid, said heat exchanger comprising a plurality of plates arranged parallel to one another and to a longitudinal direction so as to define a plurality of passages between said plates, at least one passage being formed between two adjacent plates and comprising at least one heat exchange structure equipped with at least one series of fins, said fins extending parallel to the longitudinal direction and following one another in a lateral direction which is orthogonal to the longitudinal direction and parallel to the plates, such that the fins, within the passage, define channels suitable for the flow of the refrigerant fluid or the calorigenic fluid parallel to the longitudinal direction, characterized in that at least one fin has, over at least part of its surface, a surface texturing in the form of striations arranged parallel to the longitudinal direction.

Depending on the case, the heat exchanger according to the invention may comprise one or more of the technical features given below.

The striations are arranged periodically with a period of between 0.1 and 2 mm, preferably of between 0.4 and 1 mm.

The striations are rectilinear and continuous.

The striations are arranged such that a striation is separated from an adjacent striation by a crest and has an amplitude, defined as the maximum distance between the bottom of a striation and the peak of a crest, measured orthogonally to the surface of the fin, of between 0.1 and 1 mm, preferably between 0.3 and 0.6 mm.

The surface texturing is formed such that it has a developed surface area greater than its projected surface area, with $Sd=Sp\times(1+G)$, G being an augmentation gain of between 1% and 150%, preferably between 20% and 75%.

The surface texturing is configured such that the heat exchange structure has a heat exchange coefficient increased by a multiplication factor of between 2 and 7, preferably between 2 and 5, with respect to the heat exchange coefficient of an identical structure without surface texturing.

Said at least one fin has a first surface and a second surface that are opposite to one another, each forming a lateral wall of a respective channel, the one and/or the other of said first and second surfaces having a surface texturing over all or virtually all of it.

The heat exchange structure is in the form of a corrugated product comprising at least one corrugation with corrugation peaks and corrugation troughs disposed between the plates and connected in alternation by fins, said fins thus forming corrugation legs and the lateral direction defining a corrugation direction of the heat exchange structure.

Said corrugation peaks and/or said corrugation troughs have a surface texturing over at least part of their surface.

The surface texturing is applied uninterrupted to the heat exchange structure.

The heat exchanger comprises an inlet manifold configured to distribute the refrigerant fluid or the calorigenic fluid into passages and an outlet manifold configured to discharge the refrigerant fluid or the calorigenic fluid from the passages, the inlet manifold being arranged higher up than the outlet manifold in the longitudinal direction, such that the refrigerant fluid or the calorigenic fluid flows in the passages in an opposite falling direction in the sense of the longitudinal direction.

In addition, the invention relates to a heat exchange structure for a heat exchanger of the plate and fin type, said structure being in the form of a corrugated product comprising a succession of fins connected in alternation by corrugation peaks and corrugation troughs, characterized in that said corrugated product is formed from a flat product comprising two opposing faces and at least one surface texturing in the form of a porous structure or reliefs formed on a surface of the flat product, only one of said opposing faces having said surface texturing over all or virtually all of it.

According to another aspect, the invention relates to an air separation installation separating air by distillation, comprising at least one heat exchanger according to the invention, the installation comprising feed means for distributing liquid oxygen, as refrigerant fluid, and gaseous nitrogen, as calorigenic fluid, in the passages of the heat exchanger.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DETAILED DESCRIPTION OF PREFERRED EMBODIMENTS

Figure 1:
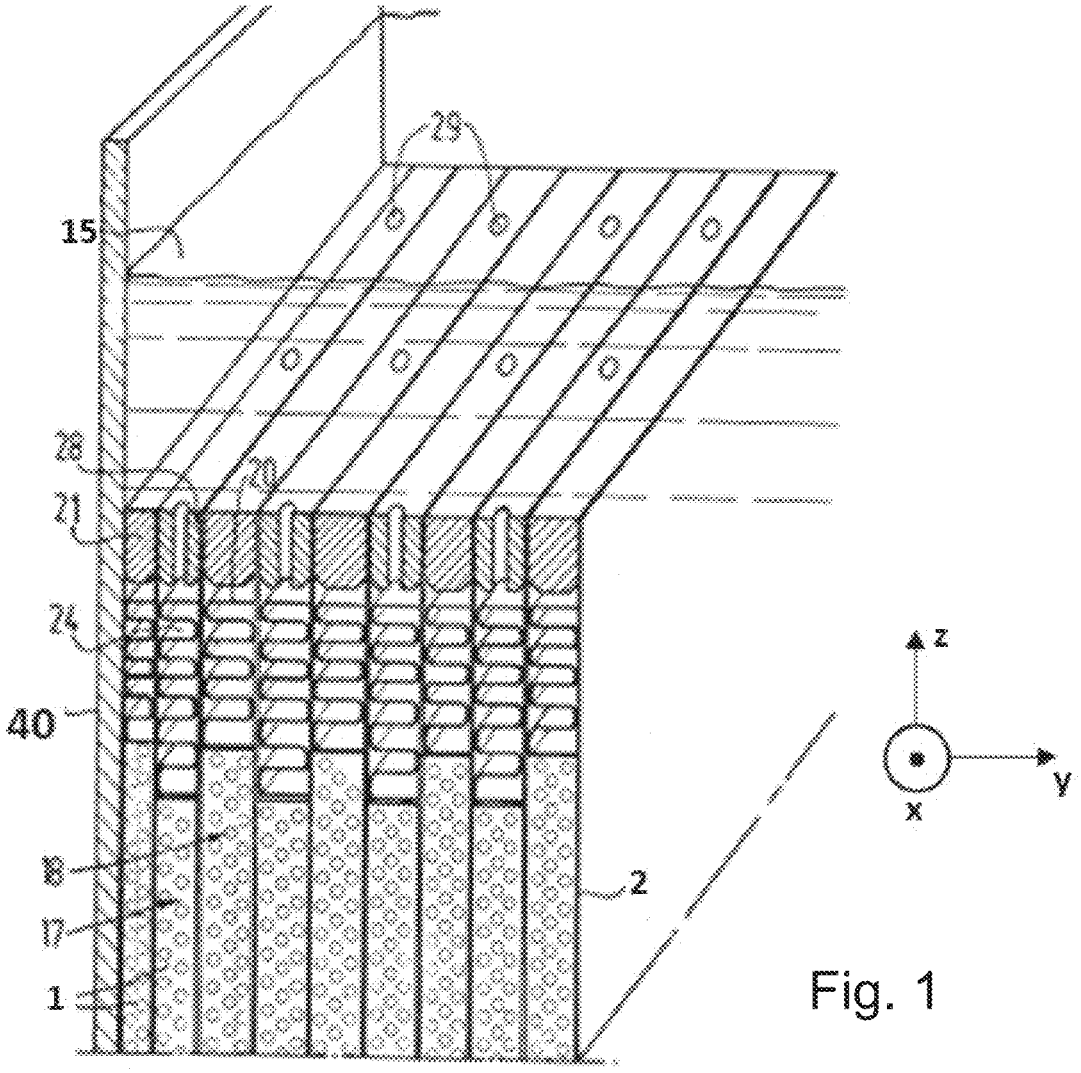
FIG. 1 is a partial three-dimensional view of an exchanger according to one embodiment of the invention.

As can be seen in FIG. 1, a heat exchanger according to the invention comprises an assembly of plates 2 arranged parallel one above another with spacing between them, thus forming multiple series of passages 17, 18 with a flat and parallelepipedal shape for the flow of at least one refrigerant fluid and at least one calorigenic fluid that are to be brought into an indirect heat exchange relationship via the plates 2. The plates 2 follow one another in a stacking direction y.

FIG. 1 illustrates one embodiment of a heat exchanger that can be used in a double-column air distillation installation. During operation, an exchange of heat takes place between liquid oxygen, as refrigerant fluid, and gaseous nitrogen, as calorigenic fluid.

The heat exchanger has a sealed shell 40 containing a body formed by an assembly of rectangular plates 2, generally made of aluminium, which are stacked parallel to one another and parallel to a longitudinal direction z. The plates 4 thus define a plurality of vaporization passages 17 intended for the flow of oxygen and condensation passages 18 intended for the flow of nitrogen. The fluids flow parallel to the longitudinal direction z.

Over most of their height, the passages 17, 18 each contain heat exchange structures 1 comprising, in this example, corrugated aluminium sheets, also heat exchange corrugations. These corrugations may be perforated or not perforated. These heat exchange structures 1 are preferably of the type with a vertical generatrix, or with an arrangement referred to as "easyway". In this case, during operation, the corrugated heat exchange structures 1 have an overall corrugation direction that is orthogonal to the longitudinal direction z and parallel to the lateral direction x in FIG. 1.

At the upper end of the passages 17, 18, the heat exchange structures 1 may be continued respectively by corrugations referred to as distribution corrugations 20, 24, serving to apportion the fluids into the respective passages. The passages 17 and 18 are upwardly closed off by horizontal bars 28 and 21, respectively.

The space located above the plates 2 encloses a bath of liquid oxygen 15. The liquid oxygen of the bath 15 flows through orifices 29 made along the bars 28 to ensure a primary distribution of the liquid oxygen between all the passages 17 for the oxygen and across the entire width of each passage 17 in the direction of the corrugations 24. The strips of corrugations 24 are generally formed of non-perforated, corrugated aluminium sheets of the type with a horizontal generatrix, or with an arrangement referred to as "hardway". In this case, during operation, the strips of corrugations 24 have an overall corrugation direction parallel to the longitudinal direction z. At the same time, the gaseous nitrogen arrives in the heat exchanger via a feed tank (not illustrated) and the distribution corrugations 20, and then flows downwards along the passages 18.

The plates 2 are spaced apart from one another by sealing bars that to not completely block the passages 17, 18 but leave free the inlet and outlet openings. The inlets and outlets of each passage serving for the circulation of one and the same fluid are joined by manifolds serving to introduce and discharge the fluid.

The longitudinal direction z is preferably vertical when the exchanger is in operation. The refrigerant and calorigenic fluids flow overall vertically and cocurrently, in the downwards direction, that is to say the opposite direction in the sense of the longitudinal direction z in FIG. 1. Advantageously, the heat exchanger comprises at least one inlet manifold configured to distribute the refrigerant fluid or the calorigenic fluid into passages 17, 18 of the body and at least one outlet manifold configured to discharge the refrigerant fluid or the calorigenic fluid from the passages 17, 18. The inlet manifold is arranged higher up than the outlet manifold in the longitudinal direction z, such that the refrigerant fluid or the calorigenic fluid flows in the passages 17, 18 in an opposite falling direction in the sense of the longitudinal direction z. Such an arrangement is preferably implemented for the refrigerant fluid and for the calorigenic fluid.

The invention will be described below more specifically within the scope of the example of FIG. 1, it being understood that its application can be envisaged in other contexts and in other variants or embodiments within the reach of a person skilled in the art, without departing from the scope of the invention. Thus, other directions and senses for the flow of the fluids are conceivable, without departing from the scope of the present invention. For example, it would be possible to envisage the fluids circulating countercurrentwise in the heat exchanger. One or more refrigerant fluids and one or more calorigenic fluids of different kinds may also flow within the passages 17, 18 of one and the same heat exchanger. It is also conceivable for the heat exchange structures of the heat exchanger to have corrugation directions, dimensions and/or shapes different from those of the embodiments described in the present application.

In particular, the heat exchanger according to the invention may be of the vaporizer-condenser type having vaporization passages fed with liquid oxygen at low pressure (typically slightly above atmospheric pressure) collected at the bottom of a column. The oxygen is vaporized by condensation of medium-pressure nitrogen (typically at 5 to 6 bar absolute) circulating in the adjacent passages. The medium-pressure nitrogen is usually withdrawn in the gaseous state from the top of a medium-pressure air distillation column to which the above-mentioned low-pressure column is connected. After having passed through the vaporizer-condenser and been at least partially condensed, this nitrogen is returned to the medium-pressure column.

Within the scope of the invention, all or some of the passages of the heat exchanger are provided with at least one heat exchange structure 1 that, within the passages, defines channels 4 for the circulation of the refrigerant fluid or the calorigenic fluid and that is able to adopt various forms.

Figure 2:
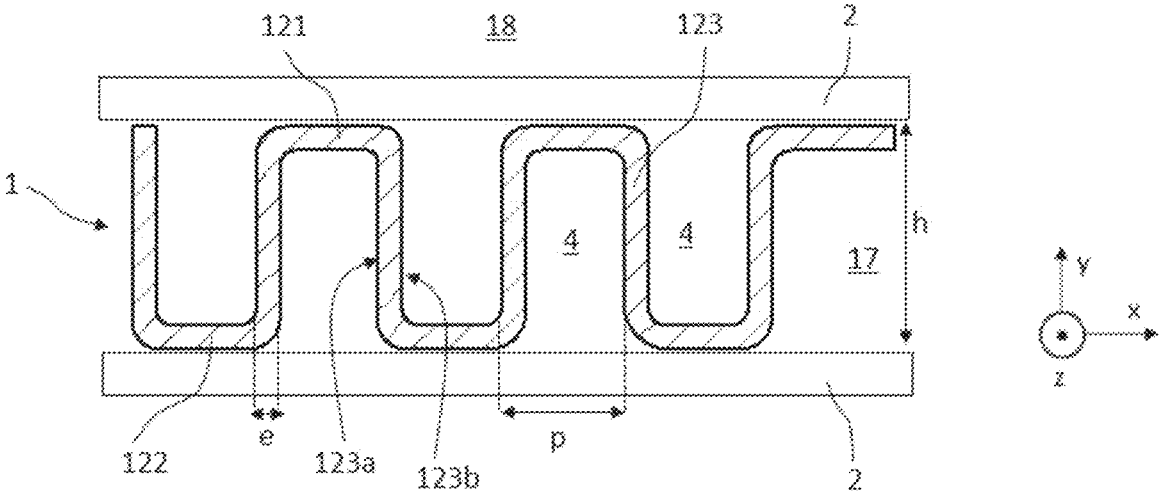
FIG. 2 is a view in cross section of a heat exchange structure in a heat exchange passage according to one embodiment of the invention.

As shown in FIG. 2, at least one passage 17 formed between two adjacent plates 2 comprises a heat exchange structure 1 equipped with at least one series of fins 123 extending parallel to the longitudinal direction z and following one another in the lateral direction x which is orthogonal to the longitudinal direction z and parallel to the plates 2. During operation, the fluid circulating in the passage 17 is in an indirect heat exchange relationship via a plate 2 that forms a primary heat exchange surface. The fins 123 form secondary heat exchange surfaces which make it possible to intensify the exchanges of heat between the fluids, and also to stiffen the passages of the exchanger by acting as spacers. The heat exchange structures 1 of the heat exchanger are connected to the plates 2 by brazing.

The structure 1 may have a corrugated shape, as shown in FIG. 2, and comprise corrugation legs 123 connected in alternation by corrugation peaks 121 and corrugation troughs 122. In this case, "fins" refer to the corrugation legs that connect the successive peaks and troughs of the corrugation.

The structure 1 may also adopt other particular forms defined in accordance with the fluid flow characteristics desired. More generally, the term "fins" covers blades or other secondary heat exchange surfaces, which extend between the primary heat exchange surfaces, that is to say the plates of the heat exchanger, in the passages of the heat exchanger.

In the embodiment according to FIG. 2, the channels 4 defined between each pair of consecutive fins 123 have a cross section with a rectangular overall shape, the fins extending overall parallel to the longitudinal direction z and parallel to the stacking direction y. It is also conceivable that the fins 123 form an angle of inclination with the direction y. It will be noted that, in the case of channels formed between the corrugation legs of a corrugated structure, the fins 123 form lateral walls of the channels, the upper walls of the channels being formed by corrugation peaks 121 or a portion of a plate 2 in the corrugation zone in question and the lower walls of the channels being formed by corrugation troughs 121 or a portion of a plate 2 in the corrugation zone in question.

It will be noted that, as heat exchange structure 1 of the corrugated product type, it is possible to use different types of corrugations usually implemented in heat exchangers of the plate and fin type, specifically straight corrugations, corrugations referred to as partially offset corrugations (of the "serrated" type), or herringbone corrugations, which may be perforated or not perforated.

The heat exchange structure 1 preferably has a height h, corresponding substantially to the height of the passage in which it is arranged, of between 3 and 10 mm. The heat exchange structure 1 may have a thickness e of between 0.2 and 0.6 mm. The fins 123 follow one another periodically with a pitch p between two successive fins. The density of fins n, i.e. the number of fins per unit of length, expressed by the relationship n=1/p, may be between 150 and 1200 fins per metre. In the case of a perforated corrugation, the percentage of perforation of the corrugation may possibly be between 1% and 10%.

Figure 3:
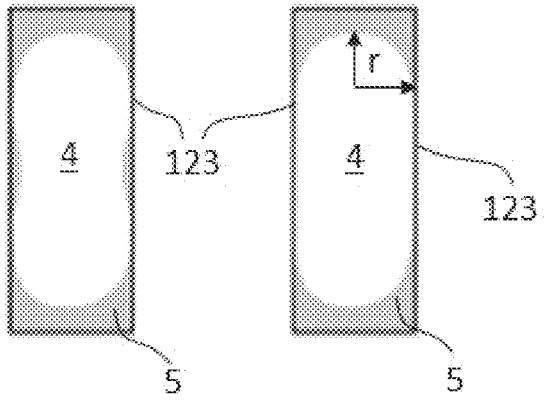
FIG. 3 is a schematic view in cross section of fluid channels formed by a heat exchange corrugation according to one embodiment of the invention.

As shown schematically in FIG. 3, the phenomenon of drainage of the liquid 5 flowing in the channels 4 of the vaporization or condensation passages takes place naturally by capillary action. The liquid 5 is taken up by capillary action in the corners of the channels and flows in a meniscus shape. The drainage capacity at the corners is relatively large, since the radius r of the menisci varies with the ¼ power of the liquid flow rate.

However, even if the thickness of liquid is markedly greater in the corners of the channels, there is a thickness of liquid film on the fins 123 which limits the heat exchange coefficient of the structure 1. On the right-hand side, the channel 4 comprises relatively little liquid. The liquid is located mainly in the corners as a result of capillary action, but wets the entire surface. When the amount of liquid increases, as is shown in the channel 4 on the left-hand side, the thickness of liquid increases, thereby further deteriorating the heat exchange capacity of the structure 1.

To remedy this, in one or more passages of the heat exchanger according to the invention there is arranged at least one heat exchange structure 1 comprising at least one fin 123 which, over at least part of its surface, has a surface texturing 23 in the form of striations arranged parallel to the longitudinal direction z.

The term "striations" is understood to mean mutually parallel furrows, or grooves, which mark a surface. It will be understood that a surface texturing 23 according to the invention may both be made in the surfaces of the constituent material of the heat exchange structures and be deposited there, that is to say result from an introduction of additional material on the surfaces of the structures. In particular, the striations may result from material being removed from the surface of the structure. The striations may be made by laser machining, by mechanical machining and/or by chemical machining.

The striations of the texturing 23 make it possible to reduce the thickness of the liquid film on the surface of the fin 123, and consequently to reduce the heat transfer resistance. Consequently, the striations lead to an increase in the heat exchange efficiency of the structure. The arrangement of the striations parallel to the longitudinal direction z, that is to say with the same orientation as that of the channels 4, makes it easier for the liquid to flow downwards in the heat exchanger. The striations thus do not obstruct the flow of the fluid circulating in the channels 4 of the structure and perform a fluid guiding function. The striations form recesses, or valleys, the function of which is to drain the liquid by capillary action and to locally reduce the thickness of liquid on the zones of the fin that are located between the striations, thus promoting the heat transfer in these zones.

Figure 4:
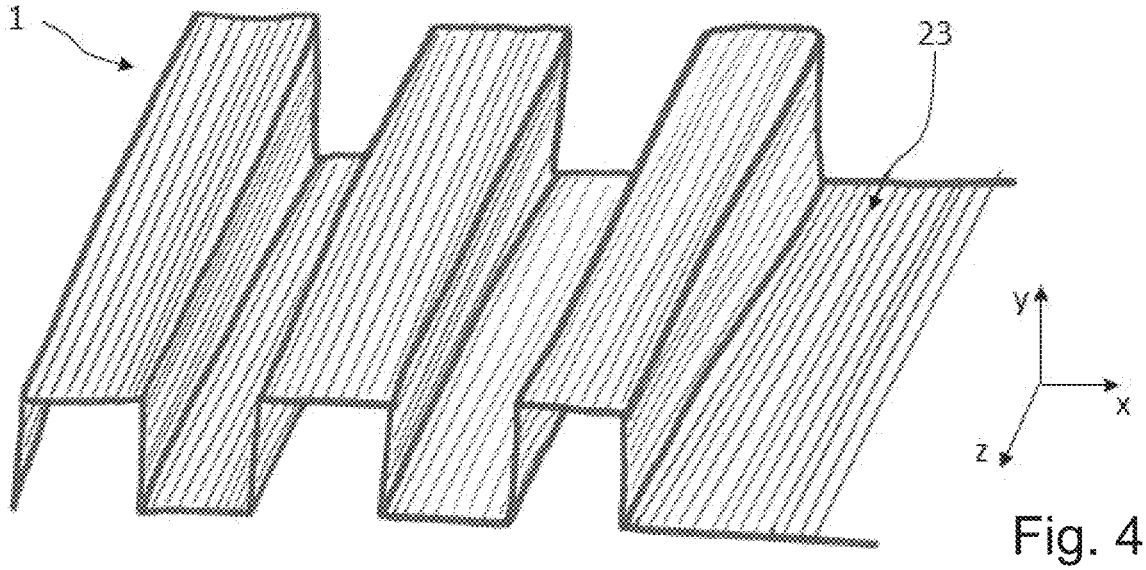
FIG. 4 is a diagram of a heat exchange structure according to another embodiment of the invention, before moulding.
Figure 5:
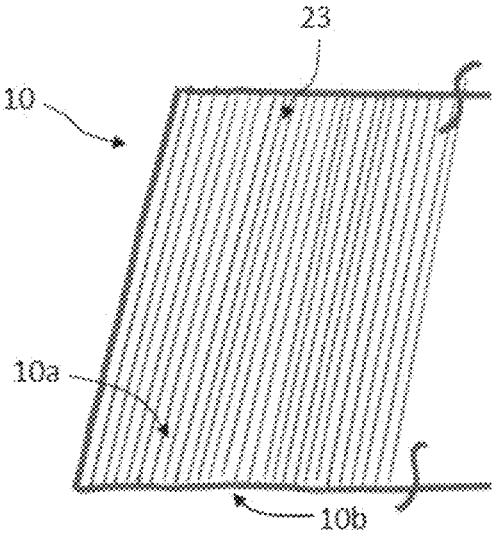
FIG. 5 is a diagram of a heat exchange structure according to FIG. 4, after moulding.

FIG. 4 is a diagram of a heat exchange structure 1 produced in the form of a corrugated product. As can be seen in FIG. 5, the striated texturing 23 can be produced on a flat product 10 which is subsequently shaped. This makes the production of the striations easier and the arrangement and dimensioning thereof are controlled more precisely. The texturing 23 is formed on at least one of the two faces 10*a*, 10*b* of the flat product. The texturing is preferably arranged on the two opposing faces 10*a*, 10*b* of the flat product, thereby making it possible to maximize the surface area of walls of the channels 4 having enhanced heat transfer efficiency.

Advantageously, the striations of the texturing zone 23 are rectilinear and continuous, that is to say are formed uninterrupted. Advantageously, the fins 123 have the surface texturing 23 on their two opposing surfaces 123*a*, 123*b*, preferably over all or virtually all of said surfaces 123*a*, 123*b*. In this way, the fins 123 delimit between them channels 4 in which the lateral walls, formed by the two fins 123, have surfaces with improved heat exchange performance. Specifically, they are those zones of the channels 4 that have the main function of ensuring the exchange of heat, the upper and lower walls of the channels having the main function of ensuring the flow of the liquid parallel to the longitudinal direction z.

It should be noted that, within the scope of the present invention, virtually all of a surface, of a face or of an element means a portion representing at least 90%, preferably at least 95%, more preferably still at least 98% of the surface area of this surface or of the total surface area of this element.

It will be noted that preferably at least one structure according to the invention is arranged in multiple passages, or even all or virtually all of the passages of the heat exchanger, in the passages for the calorigenic fluid and/or in the passages for the refrigerant fluid.

The striations preferably extend vertically during operation.

In the case of a corrugated product 1, the corrugation peaks 121 and/or the corrugation troughs 122 preferably also have two opposing surfaces, one oriented towards the side of the adjacent plate 2 and the other towards the inside of the channel 4 delimited between the two fins 123 connected to the corrugation peak or to the corrugation trough, as the case may be. At least the corrugation trough surface or the corrugation peak surface oriented towards the channel 4 has a texturing 23. In this way, the fins or corrugation legs 123 delimit between them a channel 4, the bottom or the top of which, formed by the surfaces of a corrugation trough or a corrugation peak, has inner surfaces with improved heat transfer. The surfaces of the corrugation troughs and/or of the corrugation peaks preferably have the surface texturing 23 overall or virtually all of them. It is also possible that the corrugation trough surface or the corrugation peak surface oriented towards an adjacent plate 2 has a texturing 23. This makes it easier to prepare the surface of the heat exchange structure 1, since it is not necessary to make a distinction between zones with or without texturing.

In the case of FIG. 4, the structure 1 is in the form of a straight corrugation with a single corrugation. It should be noted that the structure 1 may be in the form of a partially offset corrugation, that is to say comprising a series of corrugations which follow one another in the longitudinal direction z and are arranged offset with respect to one another in the lateral direction x. According to one possibility, the serration length, that is to say the length of a corrugation measured parallel to the longitudinal direction z, may be between 3 and 10 mm.

Figure 6:
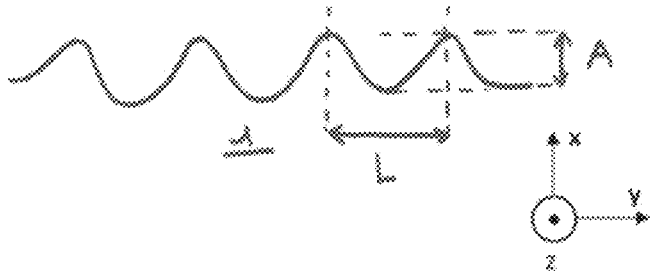
FIG. 6 is a partial diagram of a profile in cross section of a texturing according to one embodiment of the invention.

FIG. 6 is a diagram of an exemplary texturing profile 23 in cross section through a plane orthogonal to the longitudinal direction z. The texturing is made on at least one surface portion of the constituent material of the heat exchange structure 1.

The texturing striations 23 are preferably arranged periodically with a period L of between 0.1 and 2 mm, preferably of between 0.4 and 1 mm. The surface texturing is preferably such that the ratio between the height h of the fin and the period L of the striations is between 5 and 20, preferably between 5 and 10. Multiple factors can be involved in the determination of the period L. Said period is notably in line with the height of the fins or corrugation legs. Said period should also ensure good thermal performance: striations that are spaced apart too widely affect only a portion of the heat exchange surface, since the effect of drainage of the liquid extends only a certain distance on either side of the striation, whereas striations that are too close together do not drain the liquid effectively enough. Lastly, the striations should be manufacturable and economically viable.

The striations may be arranged such that a striation is separated from an adjacent striation by a crest and have an amplitude A, defined as the maximum distance between the bottom of a striation and the peak of a crest, measured orthogonally to the surface of the structure 1, of between 0.1 and 1 mm and preferably between 0.3 and 0.6 mm. Like the period, the amplitude is preferably based on various factors: geometric compatibility with the shape of the heat exchange structures in question, the thermal performance, and manufacturing and shaping constraints for the corrugations. In addition, the inventors of the present invention have demonstrated that it was advantageous, in terms of drainage of the liquid, for the striations to have an amplitude of the same order of magnitude as the thickness of the film of condensate that conventionally forms on the heat exchange structure without implementation of the invention. Thus, depending on the parameters of the structures and of the fluids in a heat exchange relationship, it has been possible to observe film thicknesses ranging notably from 50 to 300 μm. Producing the striations with an amplitude of the same order of magnitude or greater makes it possible to effectively dry out the peaks of the striations.

It should be noted that the period and amplitude values of the striations mean average values over the texturing surface in question, notably over the surface of the fin comprising the texturing.

The surface texturing 23 is preferably formed such that it has a developed surface area Sd greater than its projected surface area Sp, with Sd=Sp×(1+G), G being an augmentation gain of between 1% and 150%, preferably between 20% and 75%. The projected surface area means the projected surface area in a plane parallel to said surface area.

Advantageously, the surface texturing 23 is configured such that the heat exchange structure has a heat exchange coefficient increased by a multiplication factor of between 2 and 7, preferably between 2 and 5, with respect to the heat exchange coefficient of an identical structure without surface texturing 23. Preferably, a heat exchange structure 1 according to the invention can have a heat exchange coefficient of between 5 and 30 kW/m2/K.

It will be noted that heat exchange coefficient, or heat transfer coefficient, is understood to mean a coefficient quantifying the flow of energy passing through the heat exchange structure, by unit of surface area, of volume or of length and for a given temperature difference.

The heat exchange coefficient can be defined as follows (in this case, for a superficial heat transfer):

Math 1

$$h = \frac{\Delta Q}{A.\Delta T.\Delta t}$$

with:

h: heat exchange coefficient, expressed in watts per squared metre kelvin ($W \cdot m^{-2} \cdot K^{-1}$), ΔQ: energy transferred in joules (J), A: heat exchange surface area in square metres ($m^2$), ΔT: temperature difference between the wall in question and the fluid in degrees kelvin or degrees Celsius (K ou ° C.), Δt: time interval in seconds (s).

The heat transfer coefficient between a fluid and a structure depends on intrinsic parameters, that is to say parameters specific to the heat exchange structure itself, notably the density of the corrugation forming the structure, the thickness of the corrugation, and extrinsic parameters, that is to say parameters specific to the process implemented, notably flow rate of the fluids and temperature difference between the fluids. The heat transfer coefficient is determined using the Nusselt number (Nu) via the following relationship:

Math 2

$$Nu = \frac{h.L_c}{k}$$

with:

H: heat transfer coefficient, $L_c$: characteristic length,

K: thermal conductivity of the fluid.

Numerous empirical correlations provide an equation to calculate the Nusselt number, from which it is possible to extract the heat transfer coefficient.

In particular, in the case of single-phase liquid or gaseous fluid, the heat transfer coefficient of a structure can be determined by the Nusselt number calculated from the relationship below:

$$Nu = CjRePr^{1/3}$$

with:

Nu: Nusselt number

Cj: Colburn factor

Re: Reynolds number

Pr: Prandtl number

If a liquid-gas biphasic mixture is involved, the heat exchange coefficient can be determined using correlation methods known per se.

Within the scope of the invention, the heat exchange coefficients of the heat exchange structure with and without texturing 23 are compared to identical or virtually identical theoretical determination or measurement methods, the conditions specific to the heat exchange process (i.e. extrinsic parameters) being identical or virtually identical.

EXAMPLES

In order to demonstrate the increase in heat transfer obtained by virtue of a heat exchange structure with texturing according to the invention, a texturing 23 was produced on an initially flat and relatively smooth plate, the surface of the plate having an arithmetic roughness of 8 μm, a length of 200 mm and a width of 100 mm. The striations were formed using a mechanical tool. The striations had a mean period of 1 mm and a mean amplitude A of 280 μm (surface denoted C). The structure had a developed surface 25% larger than its projected surface.

The structure was tested in condensation mode in a passage into which was introduced gaseous nitrogen at atmospheric pressure (condensing hot fluid) in an indirect heat exchange relationship with liquid nitrogen at a lower pressure circulating in an adjacent passage (cold fluid in a state of ebullition). The pressure of the "cold" liquid nitrogen was controlled in order to vary its boiling temperature, and therefore the temperature difference between fluids (the "hot" gaseous nitrogen condensing at its condensation temperature at atmospheric pressure).

The superficial flow of heat was measured using two independent techniques, and therefore the results are identical to within 10%. The first technique, the local technique, consisted in measuring the transverse temperature gradient established in the plate separating the two fluids so as to deduce therefrom the superficial flow of heat (knowing the conductivity of the material). The measurement was carried out at different positions, the mean superficial flow being calculated from these different measurements. The second technique, the global technique, consisted in measuring the flow rate of condensed nitrogen. To this end, the condensates flowing on the plate tested were collected, over a determined period of time, in a measuring container in order to determine therefrom the volumetric flow rate, and therefore the thermal flow used for the condensation (assuming negligible heat losses).

In this experiment, it is not just the temperatures of the fluids that are measured, but also the temperature of the wall separating the two fluids. This makes it possible to determine, from the thermal flow, the condensation heat exchange coefficient independently of the ebullition heat exchange coefficient and of the heat resistance of the wall. This is essential to gauge the effectiveness of the textures proposed. In the absence of these intermediate temperature measurements, only an overall heat exchange coefficient, including these various elements in series, can be obtained. The figure therefore clearly shows the condensation heat exchange coefficient. It is plotted as a function of the corresponding temperature difference, denoted $\Delta T$, which is the temperature difference between the surface of the wall separating the fluids, i.e. the condensation side, and the dew point of the gaseous nitrogen at atmospheric pressure. It will be understood that this is a mean heat exchange coefficient.

Figure 7:
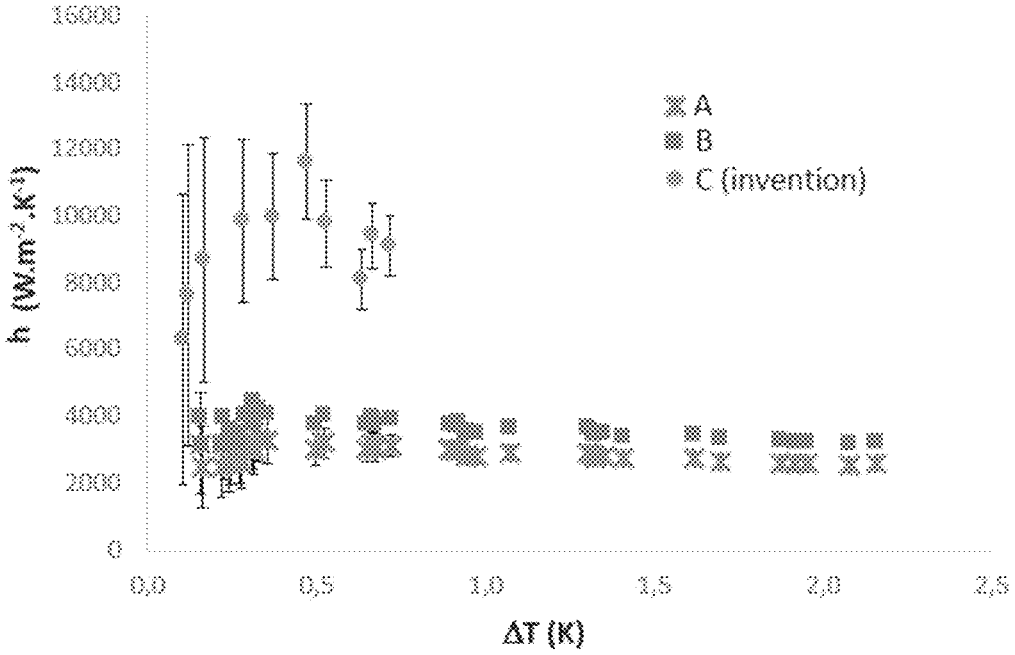
FIG. 7 shows results of experimental tests carried out with a heat exchange structure in accordance with the invention, compared with a heat exchange structure not according to the invention.

FIG. 7 shows a comparison of the heat exchange coefficients obtained with the heat exchange structure having striations according to the invention and other heat exchange structures without striations, with all intrinsic characteristics otherwise being identical. The surface denoted A is a planar surface referred to as rough, having an arithmetic roughness of 8 micrometres. This surface represents the current prior art, being made of a material typically used for the manufacture of brazed fin and plate heat exchangers, typically of aluminium or an aluminium alloy. The surface C is the striated surface according to the invention that was described above. It will be observed that the performance, in terms of the heat exchange coefficient, is about three times greater than that of the surface A. The curve B is illustrative: the surface B has the same data as the surface A, but multiplied by a coefficient equal to the increase in developed surface area generated by the striations of the surface C. The comparison of the results obtained with the surface C and the surface B demonstrates that the increase in performance is not solely caused by the increase in developed surface area but especially by the production of striations parallel to the longitudinal direction, effectively channeling the liquid.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A plate and frame heat exchanger for bringing into a heat exchange relationship at least one refrigerant fluid and one calorigenic fluid, said heat exchanger comprising a plurality of plates arranged parallel to one another and to a longitudinal direction so as to define a plurality of passages between said plates, at least one passage being formed between two adjacent plates and comprising at least one heat exchange structure equipped with at least one series of fins, said fins extending parallel to the longitudinal direction and following one another in a lateral direction which is orthogonal to the longitudinal direction and parallel to the plates, such that the fins, within the passage, define channels suitable for the flow of the refrigerant fluid or the calorigenic fluid parallel to the longitudinal direction, wherein at least one fin has, over at least part of the surface, a surface texturing in the form of striations arranged parallel to the longitudinal direction.

2. The heat exchanger according to claim 1, wherein the striations are arranged periodically with a period of between 0.1 and 2 mm.

3. The heat exchanger according to claim 2, wherein the surface texturing is such that the ratio between the height of the fins and the period of the striations is between 5 and 20, the height of the fins being measured orthogonally to the plates.

4. The heat exchanger according to claim 1, wherein the striations are rectilinear and continuous.

5. The heat exchanger according to claim 1, wherein the striations are arranged such that a striation is separated from an adjacent striation by a crest and has an amplitude, defined as the maximum distance between the bottom of a striation and the peak of a crest, measured orthogonally to the surface of the fin, of between 0.1 and 1 mm.

6. The heat exchanger according to claim 1, wherein the surface texturing is formed such as to develop a surface area (Sd) greater than the projected surface area (Sp), with $Sd=Sp\times(1+G)$, G being an augmentation gain of between 1% and 150%.

7. The heat exchanger according claim 1, wherein said at least one fin has a first surface and a second surface that are opposite to one another, each forming a lateral wall of a respective channel, the one and/or the other of said first and second surfaces having a surface texturing over all or virtually all of it.

8. The heat exchanger according to claim 1, wherein the heat exchange structure is in the form of a corrugated product comprising at least one corrugation with corrugation peaks and corrugation troughs disposed between the plates and connected in alternation by fins, said fins thus forming corrugation legs and the lateral direction defining a corrugation direction of the heat exchange structure.

9. The heat exchanger according to claim 8, wherein said corrugation peaks and/or said corrugation troughs have a surface texturing over at least part of their surface.

10. The heat exchanger according to claim 1, wherein the surface texturing is applied uninterrupted to the heat exchange structure.

11. The heat exchanger according to claim 1, further comprising an inlet manifold configured to distribute the refrigerant fluid or the calorigenic fluid into passages and an outlet manifold configured to discharge the refrigerant fluid or the calorigenic fluid from the passages, the inlet manifold being arranged higher up than the outlet manifold in the longitudinal direction, such that the refrigerant fluid or the calorigenic fluid flows in the passages in an opposite falling direction in the sense of the longitudinal direction.

12. An air separation installation separating air by distillation, comprising at least one heat exchanger according to claim 1, and in that the installation comprises feed means for distributing liquid oxygen, as refrigerant fluid, and gaseous nitrogen, as calorigenic fluid, into the passages of the heat exchanger.

13. A heat exchange structure for a heat exchanger of the plate and fin type according to the installation according to claim 12, said structure being in the form of a corrugated product comprising a succession of fins connected in alternation by corrugation peaks and corrugation troughs, wherein said corrugated product is formed from a flat product comprising two opposing faces and at least one surface texturing in the form of a porous structure or reliefs formed on a surface of the flat product, only one of said opposing faces having said surface texturing over all or virtually all of it.

14. A heat exchange structure for a heat exchanger of the plate and fin type according to claim 1, said structure being in the form of a corrugated product comprising a succession of fins connected in alternation by corrugation peaks and corrugation troughs, wherein said corrugated product is formed from a flat product comprising two opposing faces and at least one surface texturing in the form of a porous structure or reliefs formed on a surface of the flat product, only one of said opposing faces having said surface texturing over all or virtually all of it.

* * * * *